United States Patent [19]

Muzyczko et al.

[11] 4,089,789

[45] May 16, 1978

[54] CORROSION INHIBITORS

[75] Inventors: Thaddeus M. Muzyczko, Melrose Park; Samuel Shore, Roselle; Jerome A. Martin, Chicago, all of Ill.

[73] Assignee: The Richardson Company, Des Plaines, Ill.

[21] Appl. No.: 514,124

[22] Filed: Oct. 11, 1974

Related U.S. Application Data

[60] Division of Ser. No. 223,768, Feb. 4, 1972, abandoned, which is a continuation of Ser. No. 763,580, Sep. 30, 1968, abandoned.

[51] Int. Cl.[2] ..... C23F 11/04; C23G 1/06; C07C 87/29

[52] U.S. Cl. ..... 252/8.55 E; 21/2.5 R; 252/8.55 C; 252/148; 252/392; 260/570.9

[58] Field of Search ..... 252/8.55 E, 148, 392, 252/8.55 C

[56] References Cited

U.S. PATENT DOCUMENTS

| | | | |
|---|---|---|---|
| 2,395,336 | 2/1946 | MacMullen et al. | 260/570.9 X |
| 2,832,795 | 4/1958 | Hempel et al. | 260/570.9 X |
| 2,987,546 | 6/1961 | Muller | 260/501.17 X |
| 2,998,452 | 8/1961 | Bruson et al. | 260/570.9 |
| 3,127,355 | 3/1964 | De Groote et al. | 252/392 |

OTHER PUBLICATIONS

Adams et al., "Organic Reactions", vol. I, pp. 311 and 334 (1954).

*Primary Examiner*—Herbert B. Guynn
*Attorney, Agent, or Firm*—Alan M. Abrams

[57] ABSTRACT

As improved corrosion inhibitors, reaction products of alkylene oxides and blocked phenols wherein two substituents of the phenol are non-oxyalkylatable, saturated tertiary-amino alkylene groups, and acid-stable salts of these products.

17 Claims, 1 Drawing Figure

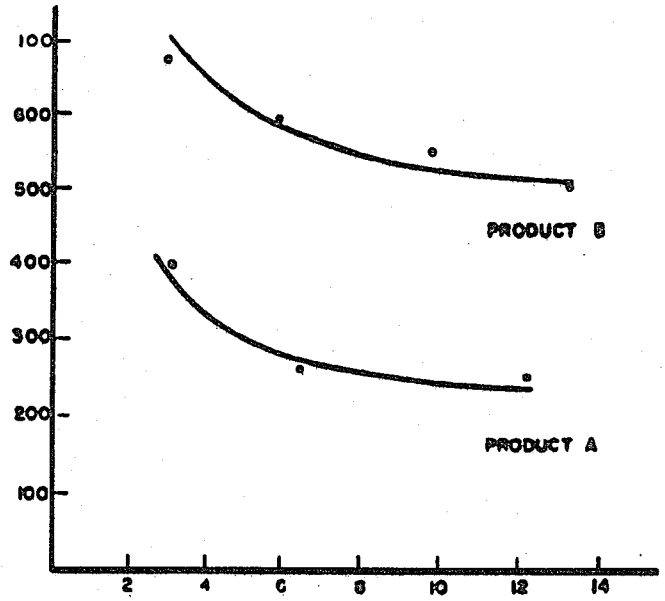
100
600
500
400
300
200
100
PRODUCT B
PRODUCT A
2
4
6
8
10
12
14

CORROSION INHIBITORS

This is a division of application Ser. No. 223,768, filed 2/4/72, now abandoned, which is a continuation of application Ser. No. 763,580, filed Sept. 30, 1968, now abandoned.

BACKGROUND OF THE INVENTION

This invention relates to corrosion inhibiting compositions useful in reducing corrosion caused by acid systems in contact with metallic surfaces. More particularly, the invention relates to corrosion inhibiting compositions which are reaction products of alkylene oxides and blocked phenols wherein two of the blocking groups are non-oxyalkylatable monoamines or acid-stable salts thereof.

Corrosion inhibition is acid system has been the subject of considerable interest in recent years. In industrial cleaning operations, where aqueous solutions of acid serve to remove scale and other deposits from metallic surfaces of industrial equipment, the inhibitors are used to reduce acid attack on the metals of construction during the cleaning operations. In processing operations where some acid is present or may be generated, inhibitors are introduced to reduce the corrosiveness of the acid. In oil well operations, corrosion inhibitors are introduced during various treatment stages and during secondary recovery operations. In all these operations, the corrosion inhibitor is in a form which is dispersible and preferable miscible in the liquid medium of the particular system.

Since the industrial equipment being protected by the inhibitor is often of considerable value or is often difficult and expensive to replace, significant importance has been given to the development of new and improved corrosion inhibitors. One area of such interest has been the organic inhibitors such as the amines, ketones, sulfides, acetylenic alcohols and the like. In respect to the amines or to their acid salts commonly formed in the acidic systems, fatty amines having one or more amine groups have been recognized as effective inhibitors. In some instances, they have been oxyalkylated through their amino hydrogens; however, this has not always resulted in effective corrosion inhibition. Rosin amines have also been used as corrosion inhibitors as have their oxyalkylated derivatives. In addition, various polymeric resins with amine functionalities have been used to some extent, although in a number of systems they have not been as effective as desired.

In contrast to the above oxyalkylated amines, we have discovered that reaction products of alkylene oxides and blocked phenols with two non-oxyalkylatable amino substituents are very effective corrosion inhibitors. As indicative of the surprising results, we have found that our amines are more effective than other oxyalkylated phenols with polyamino substituents.

SUMMARY

Briefly, the invention is directed to corrosion inhibiting compositions useful in acid systems wherein the compositions comprise reaction products of alkylene oxides and blocked phenols or their acid-stable salts and wherein each of two substituents on the blocked phenol is a non-oxyalkylatable, saturated, tertiary amino alkylene with one amino group. These inhibitors are particularly useful in aqueous systems associated with acid cleaning of industrial equipment and in aqueous hydrocarbon systems associated with oil well treatment and processing operations.

These compositions offer the advantages of being soluble in various acid systems and can also be introduced into neutral and brackish waters (commonly used in oil well treatments) through the oxyalkylated functionality without significantly reducing their usefulness in the corrosive conditions later encountered.

For the purpose of definition, blocked phenols as known in the art and described herein are descriptive of phenols which are generally resistant to reaction by aldehydes and the like through their ring hydrogens. Generally, these phenols are at least tri-substituented and have substituents in the 2, 4, 6 positions. Other substituents in the 3 or 5 position may also be present.

REFERENCE TO DRAWINGS

The accompanying drawing is a graph showing the relative performance of two compositions providing protection to a ferrous metal sample in sulfuric acid.

DETAILED DESCRIPTION

The corrosion inhibitors of the invention are useful for reducing metallic corrosion in acid systems and comprise reaction products of (A) an alkylene oxide and (B) a blocked phenol of the formula

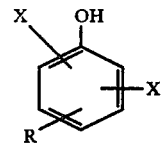

wherein each x is a non-oxyalkylatable, saturated tertiaryamino alkylene with one amino group, and R is alkyl or alkaryl, the alkylene oxide being present in an amount of at least one mole per mole of phenol; (II) acid-stable salts of these reaction products, or (III) mixtures thereof. Advantageously, each X has a total of about 3–20 carbon atoms and R is alkyl with about 1–18 carbons or is alkaryl has about 7–12 carbon atoms. Also advantageously, the amino substituents are on the 2 and 6 positions of the phenolic nucleus.

The amino group is more specifically described with X being

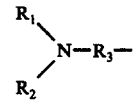

wherein $R_1$ and $R_2$ are each alkyl with about 1–9 carbon atoms and $R_3$ is alkylene with about 1–3 carbon atoms. Advantageously, $R_1$ and $R_2$ have 1–3 carbon atoms and $R_3$ has 1 carbon atom. Preferably, $R_1$ and $R_2$ each have 1 carbon atom.

Useful compositions include mixtures of the diamino blocked phenols and up to about 50 weight percent of monoamino blocked phenols or their acid-stable salts wherein the monoamino blocked phenols have the formula

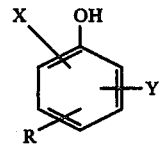

wherein X and R are as defined above and Y is alkyl with about 1–12 carbon atoms. Advantageously, X of the above formula is

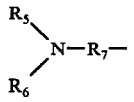

wherein $R_5$ and $R_6$ are each alkyl with about 1–9 carbon atoms and $R_7$ is alkylene with about 1–3 carbon atoms. Advantageously $R_5$ and $R_6$ have 1–3 carbon atoms and $R_7$ has 1 carbon atom. Also advantageously, X is on the 2 or 6 position of the phenolic nucleus.

These compositions are prepared advantageously through a Mannich reaction with alkyl phenols or alkaryl phenols, aldehydes, and secondary amines; or through the use of sodium dialkyl amines with dichloromethyl-phenols. The resultant products are then oxyalkylated with alkylene oxides.

Suitable phenols in the Mannich reaction are those with two active sites such as 2-, 4- or 6-methylphenol, butylphenol, octylphenol, octadecylphenol and the like with about 1–18 carbon atoms and preferably 1–12 carbon atoms, as well as naphthols, bis phenols, and the like with about 7–12 carbon atoms in the substituent. Other substituents may also be present as in 3-chloro-4-butylphenol. The di-chloro-methyl-phenols are illustrated correspondingly with the added substituent being alkyl of 1–18 carbon atoms or alkaryl of 7–12 carbon atoms. Advantageously, the phenol is a 4-substituted phenol.

For aldehydes, formaldehyde as paraformaldehyde, formalin or acetals; acetaldehydel; chloral; and the like may be used in the reactions. Preferably, formaldehyde is utilized in view of its low cost and reactivity and the advantageous products resulting from the reaction.

Secondary amines for the Mannich reaction include dialkylamines such as dimethylamine, diethylamine, methylethylamine, benzylmethylamine, dibutylamine, and the like. Preferably, the amine is saturated and has a total of 1 to 20 carbon atoms with at least one chain of 1 to 5 carbon atoms.

The resultant products are then oxyalkylated with alkylene oxides in an amount of at least one mole of alkylene oxide per mole of the phenol. This amount is generally determined by solubility factors and includes amounts up to 25 moles and more per mole of the phenol. Generally about 1 to 10 moles provides useful properties in the resultant product.

Alkylene oxides include ethylene oxide, propylene oxide, butylene oxide, epichlorohydrin, styrene oxide and the like with about 2 to about 14 carbon atoms and advantageously about 2 to about 6 carbon atoms. Ethylene and propylene oxides are preferred.

Acid stable salts are those salts formed from acids or salts which are stable in acid systems having the general formula ZA wherein Z is hydrogen or alkyl and A is an anion forming group. These include those salts formed from hydrochloric, sulfuric, phosphoric, acetic, citric, and other acids and those from salts such as methylchloride, methylbromide, butylchloride, and the like.

The above inhibitors of the invention are incorporated into an acid medium commonly utilized in industrial cleaning or encountered in processing operations or oil well treatments. In industrial cleaning, these acids include hydrochloric, sulfuric, phosphoric, acetic, citric and the like. Similar acids are used in many processing operations. In oil well treatments, hydrochloric acid is often used although other contributing corrodants such as hydrogen sulfide, dissolved oxygen, and dissolved carbon dioxide, are usually present.

The following examples illustrate some of the embodiments of this invention. It is to be understood that these are for illustrative purposes only and do not purport to be wholly definitive with respect to conditions or scope.

EXAMPLE I 2,6-dimethylaminomethyl-4-nonylphenol was prepared from approximately 215 g. of nonylphenol, 93.4 g. of 25% aqueous dimethylamine and 386.4 g. of formalin, with the formalin being added last and dropwise to a solution at about 20° C. The reacton exothermed slightly with the temperature rising to about 70° C. The reaction mixture was stirred at room temperature for about 1 ½ hours and then left overnight. The mixture was refluxed at 90°–91° C. for about 6 hours, cooled to room temperature and allowed to separate into two layers. The organic upper layer was separated and combined with an ether extract of the lower layer. The combination was dried over anhydrous $Na_2SO_4$, filtered, and the solvent was removed by vacuum stripping leaving a yellow liquid. Analysis disclosed a tertiary amine content of about 93.2% and a secondary amine content of about 6.9%. Analysis also revealed a di-amino substituted phenol of 50–60 wt. % and a mono-amino substituted phenol of 50–40 wt. %.

This product was oxylakylated with propylene oxide in respective amounts of 106 g. to 348.5 g. The product was a viscous amber oil which was insoluble in water and soluble in 10 wt. % hydrochloric acid. Analysis revealed a neutralization equivalent of about 632 indicating that about 7 moles of propylene oxide has reacted per mole of initial product.

EXAMPLE II

The methyl chloride salt of a 2,6-dimethylaminomethyl-4-nonylphenol reaction product with propylene oxide was prepared by passing a stream of methyl chloride through a solution of the product in 150 parts of isopropanol at about 24°–34° C. for 3 hours. Cooling water was applied to the flask during the reaction. After no further methyl chloride appeared to be accepted, the reaction solution was heated to about 60° C. for 1 hour. Analysis of the final product revealed a quaternary salt of about 57.6% and a residual tertiary amine content of about 3.2%, based on the amine changed initially.

EXAMPLE III

Corrosion tests were carried out on metal coupons of 316 stainless steel in 10 wt. % hydrochloric acid with the propylene oxide product and its methyl chloride salt of Examples I and II together with a control. The results are in Table I below.

TABLE I

| Inhibitor | Wt. % | Corrosion Rate (Ipy) | % Inhibition |
|---|---|---|---|
| Propylene Oxide Product of Example I | 0.10 | 0.108 | 96 |
| Methyl Chloride Salt of Example II | 0.06 | 0.067 | 98 |
| Control | — | 2.75 | — |

EXAMPLE IV

A round bottom reaction flask was charged with about one mole of nonylphenol and 2.6 moles of aqueous dimethylamine. Formalin (2.6 moles formaldehyde) was added at a temperature not exceeding 20° C. and the contents were refluxed for about six hours. The aqueous portion was separated and discarded while the product layer was vacuum stripped (water aspirator) to remove the last traces of water. The final product was a clear amber oil with an equivalent weight of 226 indicating about 50 mole percent di-amino substituted product and about an equal amount of the mono-amino substituted product. This product was ethoxylated with ethylene oxide and the final ethoxylates contained 3.0, 6.2 and 12.0 moles of ethylene oxide per mole of substrate and is identified as Product A in the described corrosion tests.

For comparison purposes, a condensation product of nonylphenol, formaldehyde and diethylenetriamine was prepared and ethoxylated. In the preparation, nonylphenol (2 moles) and paraformaldehyde (4 moles) were slurried while about 412 grams (4 moles) of diethylenetriamine was added over a period of about 95 minutes. An exotherm to 110° C. occurred. Afterwards the addition was controlled with cooling to moderate the reaction. Water was distilled off to a temperature of about 220° C. About 65 ml. of water was removed.

About 270 grams of the above product and 1.4 grams of powdered sodium hydroxide was charged into a two liter Parr autoclave. The autoclave was evacuated, purged with nitrogen and placed in its mounting. It was heated to 230° F. and bled to remove excess nitrogen and water of neutralization. An ethylene oxide cylinder was pressurized to 200 psig, with nitrogen and 61 grams bled into the autoclave. An exothermic reaction carried the temperature to 350° F., but there was no increase in pressure, indicating that the ethylene oxide reacted as fast as it was introduced. The reaction mixture was cooled to 230° F. and a 16.4 gram sample withdrawn. This sample had reacted with 2.8 moles of ethylene oxide per mole substrate as determined by a mass balance (after nitrogen purging). In a like manner ethoxylated samples of 5.8, 9.6 and 13.0 moles of ethylene oxide per mole substrate were prepared while maintaining the autoclave temperature at about 300° F. by means of an internal cooling coil. This is identified as Product B in the described corrosion tests.

Corrosion tests on 1010 steel coupons run in sulfuric acid (about 8 wt. %) were individually carried out with the above two inhibitors in concentrations of 0.1 vol. % and at a temperature of 160° F. The results are in the accompanying drawing and demonstrate the superior performance of the inhibitor with the two non-oxyalkylatable amino substituents on the oxyalkylated phenol in contrast to the performance of the inhibitor with polyamine substituents which are oxyalkylatable.

While the invention has been described in conjunction with specific examples thereof, these are illustrative only. Accordingly, many alternatives, modifications, and variations will be apparent to those skilled in the art in the light of the foregoing description, and it is therefore intended to embrace all such alternatives, modifications, and variations as fall within the spirit and broad scope of the appended claims.

We claim:

1. A method for inhibiting corrosion of ferrous metal in an acid system which comprises utilizing in such system a minor but effective amount of an inhibitor comprising an oxyalkylated phenolic composition or the acid stable salt thereof, said composition being the reaction product of an alkylene oxide having from 2 to 14 carbon atoms and a phenolic compound having two non-oxyalkylatable, saturated teriary-amino alkylene groups with the formula

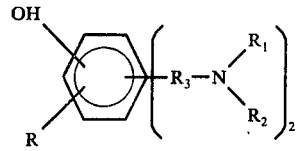

wherein R is alkyl having 1 to about 18 carbon atoms or alkaryl with about 7 to about 12 carbon atoms, $R_1$ and $R_2$ are each alkyl having from 1 to about 9 carbon atoms and $R_3$ is alkylene having 1 to about 3 carbon atoms, said reaction product having been formed by reacting from about 1 to about 25 moles of said alkylene oxide per mole of the phenolic compound.

2. The method of claim 1 wherein said oxyalkylated phenolic composition includes up to 50 weight percent of the reaction product of an alkylene oxide having 2-14 carbon atoms and a monoamino phenolic compound of the formula

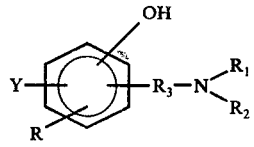

wherein R, $R_1$, $R_2$ and $R_3$ are defined in claim 21 and Y is alkyl of 1 to 12 carbon atoms, said oxyalkylated monoamino phenolic composition having been formed by reacting from about 1 to about 25 moles of said alkylene oxide per mole of the phenolic compounds.

3. A method for corrosion inhibition in the treatment of oil wells comprising incorporating the inhibitor of claim 1 in a liquid hydrocarbon medium in a minor but effective amount and thereafter injecting said medium into an oil well.

4. The method of claim 1 wherein said inhibitor includes mixtures of said salts and the composition.

5. The method of claim 1 wherein $R_1$ and $R_2$ are each alkyl with about 1-3 carbon atoms and $R_3$ is alkylene with 1 carbon atom.

6. The method of claim 5 wherein $R_1$ and $R_2$ are methyl.

7. The method of claim 5 wherein R is alkyl with about 1-12 carbon atoms.

8. The method of claim 1 wherein said salt is derived from the reaction of ZA and the oxyalkylated phenolic composition which is formed from the reaction of the ethylene oxide and the phenol, wherein Z is hydrogen or alkyl and A is an anion forming group.

9. The method of claim 8 wherein ZA is HCl.

10. The method of claim 8 wherein ZA is methylchloride.

11. The method of claim 8 wherein ZA is butylchloride.

12. The method of claim 8 wherein ZA is $H_2SO_4$.

13. The method of claim 8 wherein ZA is $CH_3COOH$.

14. The method of claim 8 wherein ZA is citric acid.

15. The method of claim 8 wherein ZA is $H_3PO_4$.

16. The method of claim 8 wherein ZA is methyl bromide.

17. The method of claim 8 including mixtures of said salts and the reaction products.

* * * * *

UNITED STATES PATENT AND TRADEMARK OFFICE

CERTIFICATE OF CORRECTION

PATENT NO. : 4,089,789

DATED : May 16, 1978

INVENTOR(S) : Thaddeus M. Muzyczko et al.

It is certified that error appears in the above-identified patent and that said Letters Patent are hereby corrected as shown below:

Column 6, line 31, "claim 21" should read --claim 1--

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*